US005964170A

United States Patent [19]

Gries

[11] Patent Number: 5,964,170

[45] Date of Patent: Oct. 12, 1999

[54] SEWING MACHINE WITH THREAD-CUTTING DEVICE

[75] Inventor: Franz Gries, Trippstadt, Germany

[73] Assignee: G.M. Pfaff Aktiengesellschaft, Kaiserslautern, Germany

[21] Appl. No.: 09/075,969

[22] Filed: May 11, 1998

[51] Int. Cl.[6] ..... D05B 65/00

[52] U.S. Cl. ..... 112/291

[58] Field of Search ..... 112/291, 294, 112/297, 300; 83/910, 13, 39, 202

[56] References Cited

U.S. PATENT DOCUMENTS

| | | | |
|---|---|---|---|
| 1,395,274 | 11/1921 | Hagelstein | 112/297 X |
| 3,624,735 | 11/1971 | Hedegaard et al. | 112/291 |
| 3,640,236 | 2/1972 | Nicolay | 112/291 X |
| 3,658,021 | 4/1972 | Hedegaard et al. . | |
| 3,894,502 | 7/1975 | Hager et al. | 112/291 X |
| 4,589,362 | 5/1986 | Dusch | 112/297 X |

FOREIGN PATENT DOCUMENTS 23 25 609 C2 3/1974 Germany .

*Primary Examiner*—Ismael Izaguirre

*Attorney, Agent, or Firm*—McGlew and Tuttle, P.C.

[57] ABSTRACT

The device includes cutting of the needle and hook thread while forming short fabric-side thread ends in a double-thread lockstitch sewing machine with a hook rotating in a horizontal plane under a needle plate. A thread catch device with a cutting edge is provided. A knife is provided cooperating with the cutting edge and with a thread clamp for the hook thread. The process includes moving the catch thread device from a resting position into a movement reversal position, moving the knife and the thread clamp from a resting position into a cutting and pickup position located adjacent to the stitch hole of the needle plate, moving the catch thread device to grasp the hook thread and the fabric-side part of the needle thread loop in a first partial step into an intermediate position, in which the needle thread loop is then pulled up to the catch thread device, returning the catch thread device into its resting position in a second partial step, pulling the hook thread first off from the thread reserve by the catch thread device during the second partial step, then introducing the hook thread into the thread clamp, and cutting the needle thread and the hook thread in the vicinity of the stitch hole in cooperation with the knife and after the cutting of the threads, returning the knife and the thread clamp into their resting positions, while the thread clamp pulls off more hook thread from the thread reserve.

11 Claims, 2 Drawing Sheets

1
G
4
3
22
21
27
44
43
45
23
24
26
25
8
7
6
NN
5

1
4
NV
3
22
21
44
NN
G
28
36
39
6
2
8
5
20

1
NV
4
21
3
G
44
7
23
24
26
25
45
NN
27
2

1
22
4
3
42
40
43
47
G
2
NV
G
NN

SEWING MACHINE WITH THREAD-CUTTING DEVICE

FIELD OF THE INVENTION

The present invention pertains to a process for cutting sewing threads with a thread-cutting device and a sewing machine for carrying out the process.

BACKGROUND OF THE INVENTION

DE 23 25 609 C2 pertains to a thread-cutting device for sewing machines with a hook rotating in a horizontal plane. A catch thread device, which has an arm movable between the needle plate and the bobbin case of the hook, is fastened on the side of the hook shaft on a shaft parallel to that shaft. A separating finger, a catch hook for the hook thread and a catch shoulder for the needle thread are provided at the free end of the arm, and these catching elements are located essentially in a vertical plane. A cutting edge is provided in the end area of the catch shoulder. The thread-cutting device also has a knife cooperating with the cutting edge, which is fastened at a spaced location from the stitch hole of the needle plate. A hook thread clamp is fastened on the side of the knife. The catching elements of the catch thread device move during the thread separation and thread catching in the space between the jacket surface of the bobbin case and the radially offset and upwardly extending bobbin case stop finger, which engages between two stop cams contained on the underside of the needle plate.

Thread-cutting devices of this type have now been successfully used for more than 20 years. They bring about a reliable cutting of the sewing thread and generate sufficiently long thread ends connected to the corresponding thread reserve, so that a reliable connection of the thread is guaranteed at the beginning of the sewing process. The thread ends remaining on the fabric usually have a length of at least 15–17 mm. Thread ends of this length are in many cases unproblematic. However, there are products in which such long thread ends are disturbing. For example, seam spaces of 10 mm are common in the manufacture of pads and the manufacture of vehicle seats. In these cases, thread ends having a length of 15–17 mm project over the finished product by 5–7 mm, which makes necessary a subsequent finishing, i.e., the cutting off of the projecting thread ends.

U.S. Pat. No. 3,658,021 (corresponding to DE PS 19 41 681) describes a thread-cutting device for sewing machines with a hook rotating in a horizontal plane, in which the needle thread and the hook thread are cut off at a relatively short distance under the fabric. One catch thread device and thread deflector each, designed as circle ring segments, as well as a knife, which is likewise designed as a circle ring segment and is arranged between them, are arranged coaxially to one another for this purpose and are movably mounted in guide grooves of a support plate, which grooves extend eccentrically to the hook. The catch thread device is moved by means of a connecting rod mechanism from the starting position into the catching position, while it penetrates into the needle thread loop and catches the hook thread with a barb. After reaching the reversal position, the catch thread device is returned into its starting position. The fabric-side parts of the needle thread and hook thread are now pressed by the thread deflector moving together with the knife in a direction opposite that of the catch thread device into a groove of the catch thread device and the hook thread is now introduced into a stationary thread clamp. The knife and a cutting edge provided at the end of the groove of the catch thread device meet in the area of the stitch hole and cut the needle thread and the hook thread, and especially short thread ends are obtained on the fabric side. The satisfactory grasping of the sewing threads is guaranteed here by the thread guide of the hook thread having been modified at the bobbin case of the hook to the extent that it extends upward much more steeply in the vicinity of the top finger than in the case of normal, horizontally rotating hooks.

Even though it would be possible to obtain especially short thread ends on the fabric side with this thread-cutting device, which would not require any subsequent finishing operations on the seam and therefore would meet the corresponding requirements of the industry, this thread-cutting device has not been able to become successful in practice. This was certainly due, among other things, to the fact that the hook would have to be modified, so that it would not be possible to use a standard hook in connection with this thread-cutting device. The main reason for the failure is, however, the fact that a thread deflector moving in a direction opposite the direction of the catch thread device is also needed for grasping the threads, in addition to the catch thread device, and that a device comprising circle ring segments movable in relation to one another is highly susceptible to contamination with finishing agent-containing dust generated during sewing, which acts in connection with lubricants, such as abrasive paste and leads to premature wear and possibly to stiff run of the components.

SUMMARY AND OBJECTS OF THE INVENTION

The primary object of the present invention is to provide a process for cutting sewing threads, which leads to especially short fabric-side thread ends in conjunction with a thread-cutting device of a simple design.

The process according to the invention provides a cutting of the needle and hook thread while forming short fabric-side thread ends in a double-thread lockstitch sewing machine with a hook rotating in a horizontal plane under a needle plate and with a thread-cutting device with a thread catch device. At the thread catch device a cutting edge is provided. A knife is provided cooperating with the cutting edge and with a thread clamp for the hook thread. The process includes the following steps:

a) moving the catch thread device from a resting position into a movement reversal position;

b) moving the knife and the thread clamp from a resting position into a cutting and pickup position located adjacent to the stitch hole of the needle plate;

c) moving the catch thread device to grasp the hook thread and the fabric-side part of the needle thread loop in a first partial step into an intermediate position, in which the needle thread loop is then pulled up to the catch thread device;

d) returning the catch thread device into its resting position in a second partial step;

e) pulling the hook thread first off from the thread reserve by the catch thread device during the second partial step, then introducing the hook thread into the thread clamp, and cutting the needle thread and the hook thread in the vicinity of the stitch hole in cooperation with the knife; and f) after the cutting of the threads, returning the knife and the thread clamp into their resting positions, while the thread clamp pulls off more hook thread from the thread reserve.

According to the invention, a sewing machine is provided for carrying out the process. The sewing machine includes a needle bar carrying a needle, a thread take-up lever for the needle thread, a needle plate with a stitch hole for the passage of the needle, a hook rotating in a horizontal plane, and a thread-cutting device. The thread-cutting device is provided with a catch thread device arranged on a bearing bolt arranged in parallel to and at a spaced location from the axis of rotation of the hook. A thread catch element for the hook thread, a thread catch element for the needle thread loop, and a cutting edge are also provided as part of the thread-cutting device. The thread-cutting device also has a knife mounted pivotably on the bearing bolt of the catch thread device, a thread clamp mounted pivotably on the bearing bolt of the catch thread device and a drive means for the catch thread device, the knife and the thread clamp. The catch thread device can be moved between a resting position, a movement reversal position and an intermediate position. The knife as well as the thread clamp can be moved between a resting position and a cutting and pickup position.

Due to the measure that not only the knife, but also the thread clamp for the hook thread is moved from a resting position into a cutting and pickup position located in the vicinity of the stitch hole and more hook thread is pulled from the hook by the thread clamp after the thread cutting during the return movement of the thread clamp into its resting position, it is achieved in sewing machines with hooks of a standard design rotating in a horizontal plane, without the use of a thread deflector cooperating with the catch thread device, that especially short fabric-side thread ends are obtained, on the one hand, and sufficiently long reserve-side thread ends are formed for the proper first stitch formation of the next seam, on the other hand.

A variant of the process guarantees that no relative movement takes place between the thread clamp and the catch thread device during the return movement of the thread clamp into its resting position, and the catch thread device therefore does not compromise the hook thread-pulling movement brought about by the thread clamp.

The knife and the thread clamp or its support may also be arranged pivotably on the bearing bolt of the catch thread device. This makes possible a very compact, space-saving design of the thread-cutting device.

A simplification of the design of the thread-cutting device may be attained due to the knife and the thread clamp being arranged on a common support, on the one hand, and due to the thread clamp being formed by only a leaf spring and a section of the catch thread device cooperating therewith, on the other hand.

A separate drive means for moving the knife and the thread clamp may be eliminated. A chronologically coordinated movement of the catch thread device, on the one hand, and of the knife and thread clamp, on the other hand, may be achieved.

The use of the thread-cutting device according to the present invention in conjunction with a camless needle plate, i.e., with a needle plate that is completely flat on its underside in the area of the stitch hole, makes it possible to bring the path of movement of the catch thread device and of the knife even closer to the stitch hole and thus to obtain even shorter thread ends.

The process according to the present invention and the thread-cutting device designed correspondingly are suitable not only for sewing machines with simple feed dog transport and with a needle plate with a stitch hole as the passage opening for the needle. The process and the thread-cutting device can also be used just as advantageously in sewing machines with other types of feed, e.g., in sewing machines with combined sliding wheel, castor and needle feed, in which the passage opening in the needle plate is designed as an elongated hole, or in sewing machines with combined feed dog and needle feed, in which the stitch hole is not provided in the needle plate, but in the feed dog.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
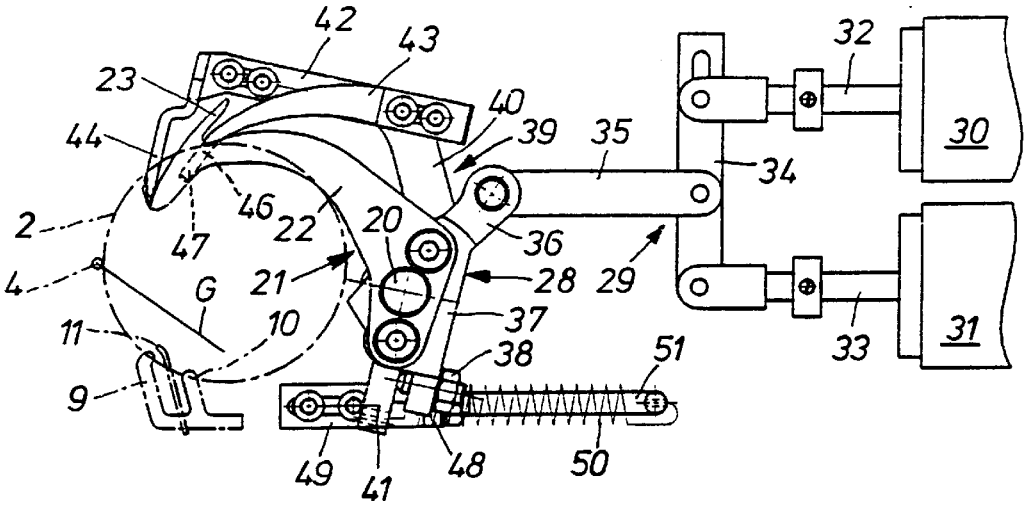
FIG. 1 is a top view of the thread-cutting device, wherein the catch thread device, the knife and the thread clamp are in the resting position.

Referring to the drawings in particular, the thread-cutting device is built into a sewing machine, which corresponds to that known from DE 23 25 609 C2 (which is hereby incorporated by reference). The sewing machine therefore also has a thread-guiding needle 1 moving up and down, a thread take-up lever, not shown (this thread take-up lever corresponds to the thread take-up lever 8 in the sewing machine known from DE 23 25 609 C2), and a hook 2 rotating in a horizontal plane. The hook 2 is arranged under a needle plate 3, which has a stitch hole 4 for the passage of the needle 1.

The hook 2 comprises, in the known manner, a hook body 6 fastened to the hook shaft 5, with a hook tip 7 provided on it and with a bobbin housing 8 mounted in the hook body 6. The hook thread G, which is led out of the bobbin housing 8 on its top side, is arranged on a bobbin, not shown, in the bobbin housing 8 in the known manner. The bobbin housing 8 is secured against rotation by two stop cams 9, 10 shown by dash-dotted line in FIG. 1 and by a spring bar 11 arranged between them. This securing against rotation corresponds to the securing against rotation as described in DE 34 46 547 C1. Due to the use of this securing against rotation, it is possible to use a so-called camless needle plate 3, which is completely flat on its underside in the area of the stitch hole 4.

A catch thread device, which has an arm 22 extending between the hook 2 and the needle plate 3, is arranged on the side of the hook shaft 5 on a bearing bolt 20 that is parallel to the said hook shaft. An obliquely downwardly directed separating finger 23, and, at a spaced location from it, a first catch hook 24 for the hook thread G and, at a spaced location from the first catch hook 24, a second catch hook 25 for the needle thread loop are arranged at the free end of the arm 22. The first catch hook 24 contains a groove 26 open toward the outside. A cutting edge 27, which extends in a vertical plane, is provided at the second catch hook 25.

The arm 22 of the catch thread device 21 is screwed onto a support 28, which is in turn arranged on the bearing bolt 20. The support 28 is connected to a drive means 29, which corresponds to that in DE 23 25 609 C2. Thus, it has two electromagnets 30, 31, whose tie rods 32, 33 act on a double lever 34. This double lever 34 is connected via a connecting rod 35 to a first arm 36 of the support 28. An adjustable stop screw 38 is arranged on a second arm 37 of the support 28.

Figure 3:
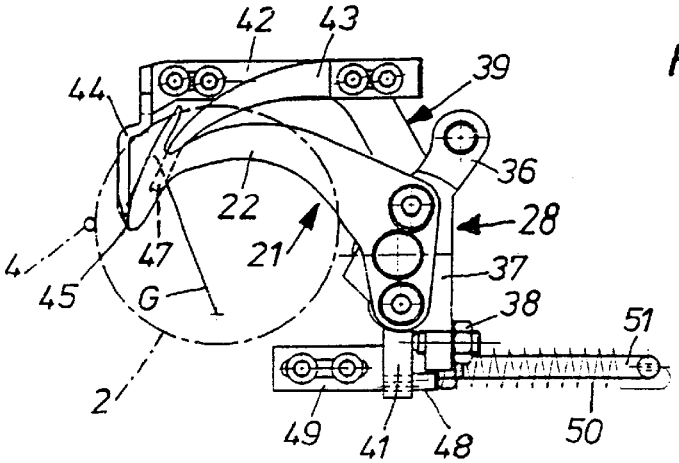
FIG. 3 is a top view of the thread-cutting device at the time of the cutting of the threads.

A two-armed lever 39, which has a bracket 40 and a stop arm 41, is also arranged rotatably on the bearing block 20. A holding plate 42 and an arc-shaped leaf spring 43 are fastened to the bracket 40. A knife 44, whose cutting edge 45 extends vertically, is adjustably fastened at the free end of the holding plate 42. In the positions of the catch thread device 21 and of the lever 39 shown in FIGS. 1 and 3, the free end of the leaf spring 43 and the horizontally extending section 46 of the arm 22 covering the end of the leaf spring together form a thread clamp 47 for the hook thread G.

A stop piece 48, which is part of a stationarily arranged, but adjustable support plate 49, is arranged in the path of pivoting of the stop arm 41. One end of a tension spring 50, whose other end is fixed at an extension 51 of the support plate 49, acts on the end of the stop arm 41. In the resting position of the support 28 with the catch thread device 21, which position is shown in FIG. 1, the tension spring 50 holds the stop arm 41 of the lever 39 in contact with the stop screw 38.

Mode of Operation

The sewing machine is stopped at the end of the seam with the needle 1 in the lower position. The sewing machine is then again driven briefly, during the course of which the hook performs a complete revolution and the needle 1 is moved upward.

Figure 2:
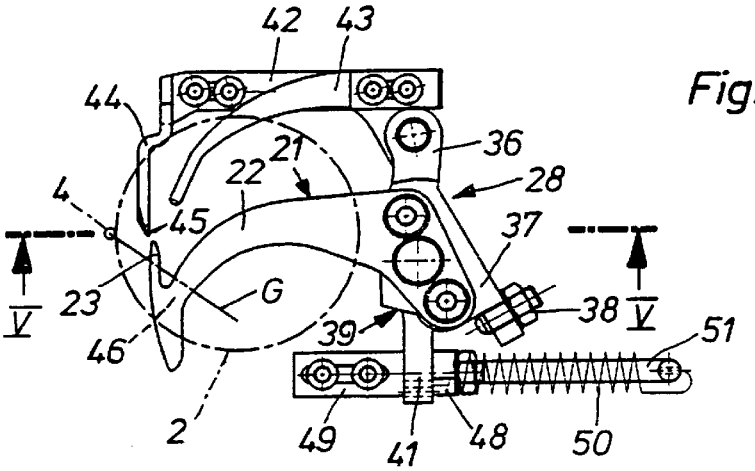
FIG. 2 is a top view of the thread-cutting device, wherein the catch thread device is in the movement reversal position, the knife in the cutting position, and the thread clamp in the pickup position.

When the tip of the needle is located above the needle plate 3, the two electromagnets 31, 32 are energized such that their tie rods 32, 33 extend. As a result, they cause the support 28 with the catch thread device 21 fastened to it to be pivoted from the resting position according to FIG. 1 counterclockwise into the movement reversal position according to FIG. 2. During the pivoting of the support 28, the tension spring 50 first continues to hold the stop arm 41 in contact with the stop screw 38, so that the lever 39 is pivoted synchronously with the support 28. This joint pivoting of the lever 39 takes place until the stop arm 41 strikes the stationary stop piece 48 and prevents the lever 39 from being pivoted further together.

In the pivoted position of the lever 39, which is set by the adjustable stop piece 48, the knife 44 is in the cutting position located relatively close to the stitch hole 4, and the leaf spring 43 as part of the thread clamp 47 is in its pickup position.

Figure 4:
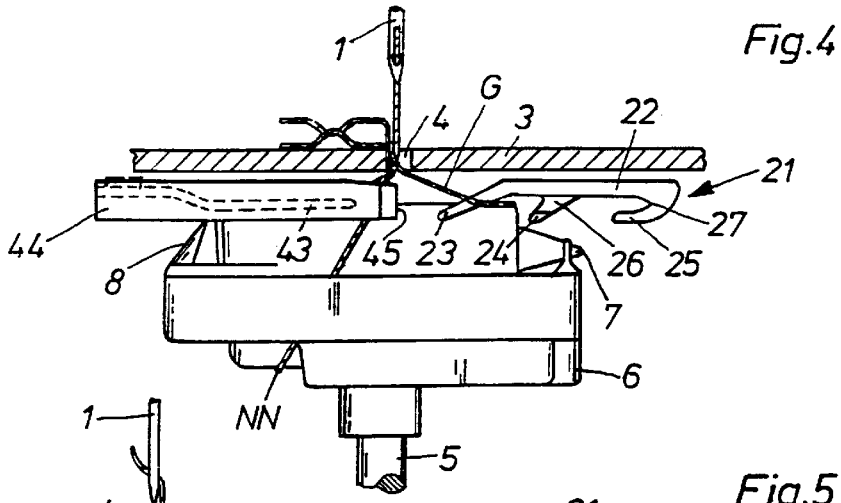
FIG. 4 is a side view of the hook and of the catch thread device in the movement reversal position.
Figure 5:
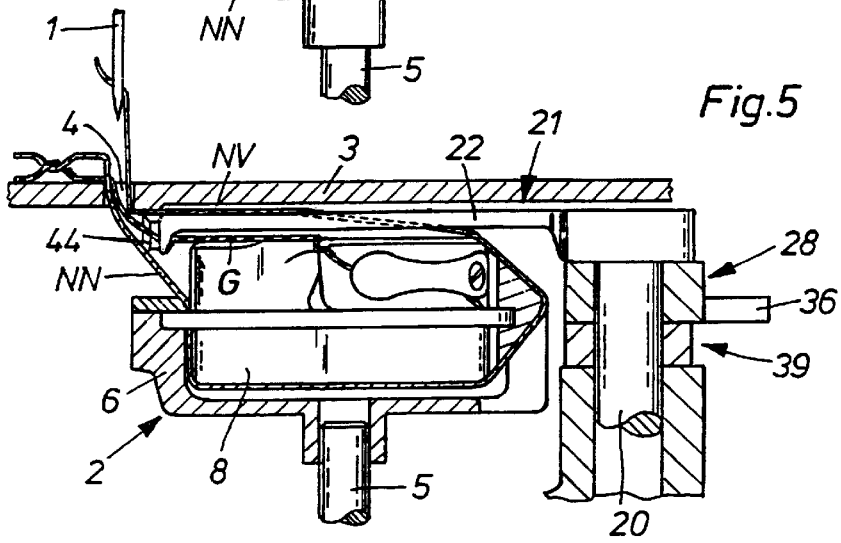
FIG. 5 is a partial section essentially along the line V—V in FIG. 2, wherein the catch thread device is shown in a position located between the movement reversal position and the cutting position.

In the course of the further counterclockwise pivoting movement of the catch thread device 21, the thread hooks 25 and 24 slide with their obliquely extending backs past the hook thread G rising obliquely toward the stitch hole 4. After the catch thread device 21 has reached its movement reversal point, the hook thread G is located between the separating finger 23 and the catch hook 24, as is shown in FIG. 4.

Figure 6:
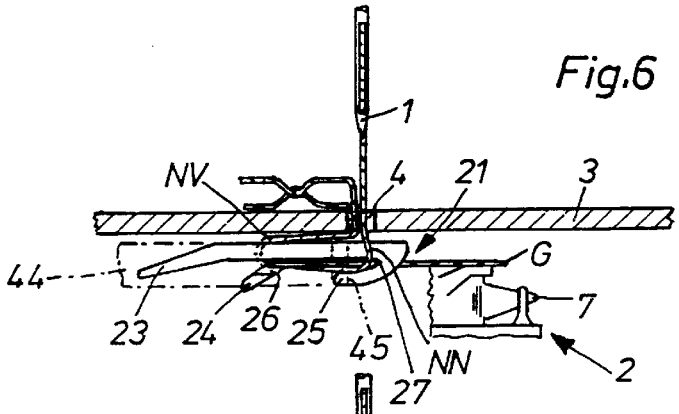
FIG. 6 is a side view of the catch thread device shortly before the cutting of the threads.
Figure 7:
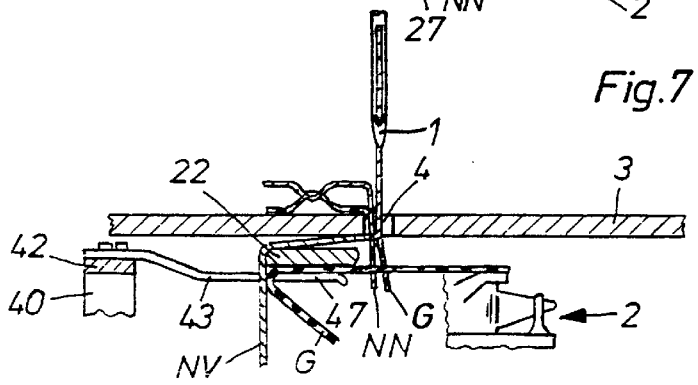
FIG. 7 is a side view of the catch thread device and of the thread clamp after the cutting of the threads.

Immediately after reaching the movement reversal point, one of the two electromagnets 30 or 31 is reversed, and its tie rod 32 or 33 is withdrawn as a result. The consequence of this is that the catch thread device 21 is pivoted into the intermediate position shown in FIG. 6. During this first, clockwise pivoting step, the separating finger 23 moves through under the leg NV of the needle thread loop leading to the needle 1 and to the thread reserve, not shown, and into the needle thread loop surrounding the bobbin housing 8. The catch hook 24 now catches the hook thread G and pulls off hook thread G from its reserve in the hook 2 during the further course of the pivoting movement of the catch thread device 21. The hook thread G runs from the bobbin housing 8 under the arm 22 and behind and past the rear catch hook 25 to the front catch hook 24 and from there, lying within the groove 26, in the direction of the stitch hole 4. The section 46 of the arm 22 comes into the area of the front end of the leaf spring 43 during the pivoting movement of the catch thread device 21 and pushes the part of the hook thread G located under the arm 22 into the thread clamp 47 formed by the cooperation of the section 46 with the leaf spring 43.

In the intermediate position of the catch thread device 21, its cutting edge 27 is located at a short distance in front of the edge 45 of the knife 44. The knife 44, which is in close contact with the front side of the arm 22, now causes the hook thread G to extend essentially horizontally from the front catch hook 24 to the knife edge 45 and to rise essentially vertically to the stitch hole 4 from there.

The catch thread device 21 is stopped in the intermediate position until the needle thread loop has not only been led completely around the bobbin housing 8, but it has also been pulled up by the thread take-up lever to the catch thread device 21. The needle thread now runs, coming from the needle 1, as a reserve-side loop leg NV, above the arm 22 up to its front narrow side and from there behind and past the front catch hook 24 to the rear catch hook 25 and from the cutting edge 27 of that catch hook to the stitch hole 4 as a fabric-side loop leg NN.

The other electromagnet 31 or 30 is then also reversed and, as a result, the catch thread device 21 is moved into its resting position in a second, likewise clockwise pivoting step.

Shortly after the beginning of the second pivoting step, the cutting edge 27 of the catch thread device 21 meets the edge 45 of the knife 44, which is still in its cutting position at this point in time, as a result of which the hook thread and the needle thread are cut. Immediately after the cutting of the threads, the stop screw 38 of the support 28 strikes the stop arm 41 of the lever 39 and pivots it beginning from this point in time synchronously with the catch thread device 21 into the resting position. The thread clamp 47 pulls off more hook thread G from its reserve in the hook 2 during the common pivoting of the support 28 and the lever 39. It is thus guaranteed that a sufficiently long hook thread end has been formed for the proper first stitch formation of the next seam and that it is also held reliably clamped.

The short length of the fabric-side thread ends is due primarily to the fact that the knife 44 can be moved from a resting position located away from the stitch hole 4 into a cutting position located adjacent to the stitch hole 4. Another important contribution to the even further shortening of the fabric-side thread ends is made by the use of the camless needle plate 3, because the path of movement of the catch S thread device 21 and the knife 44 and consequently also the cutting position can thus be brought much closer to the stitch hole 4 than in the case of a usual, cam-equipped needle plate.

The holding force of the knife 44 acting during the thread cutting is applied by the tension spring 50. If especially tear-resistant threads are processed, which offer an especially high resistance to cutting, it could be useful to associate with the lever 39 an electromagnet or a compressed air cylinder, whose connecting rod or piston rod would act on the lever 39, wherein the magnet or the cylinder would be controlled such that it would exert a holding force on the lever 39 and consequently on the knife 44 during the thread cutting only and would be switched off or ventilated immediately thereafter.

While a specific embodiment of the invention has been shown and described in detail to illustrate the application of the principles of the invention, it will be understood that the invention may be embodied otherwise without departing from such principles.

What is claimed is:

1. A process for cutting the needle and hook thread while forming short fabric-side thread ends with a double-thread lockstitch sewing machine having a hook rotating in a horizontal plane under a needle plate and with a thread-cutting device with a thread catch device, at which a cutting edge is provided, with a knife cooperating with the cutting edge and with a thread clamp for the hook thread, the process comprising the steps of:

moving the catch thread device from a resting position into a movement reversal position;

moving the knife and the thread clamp from a resting position into a cutting and pickup position located adjacent to the stitch hole of the needle plate;

moving the catch thread device in a first partial step into an intermediate position, in which the needle thread loop is then pulled up to the catch thread device to grasp the hook thread and the fabric-side part of the needle thread loop;

returning the catch thread device into its resting position in a second partial step;

pulling the hook thread first off from the thread reserve by the catch thread device during the second partial step, then introducing the hook thread into the thread clamp;

cutting the needle thread and the hook thread in the vicinity of the stitch hole in cooperation with the knife; and returning the knife and the thread clamp, after the cutting of the threads, into their resting positions, while the thread clamp pulls off more hook thread from the thread reserve.

2. The process in accordance with claim 1, wherein at least the thread clamp can be returned into its resting position together with the catch thread device after the cutting of the threads, wherein both are moved on paths extending in the same direction.

3. A sewing machine, comprising:

a needle bar carrying a needle;

a thread take-up lever for needle thread;

a needle plate with a stitch hole for the passage of said needle;

a hook rotating in a horizontal plane; and a thread-cutting device with a said catch thread device arranged on a bearing bolt arranged in parallel to and at a spaced location from an axis of rotation of said hook, with a thread catch element for the hook thread, with a thread catch element for the needle thread loop, and with a cutting edge, a knife mounted pivotably on said bearing bolt of said catch thread device, a thread clamp mounted pivotably on said bearing bolt of said catch thread device, and a drive means for said catch thread device, said knife and said thread clamp, wherein said catch thread device can be moved between a resting position, a movement reversal position and an intermediate position, and said knife as well as said thread clamp can be moved between a resting position and a cutting and pickup position.

4. The sewing machine in accordance with claim 3, wherein said knife and said thread clamp are arranged on a common support.

5. The sewing machine in accordance with claim 4, wherein said thread clamp is formed by a leaf spring fastened to said support and a horizontally extending section of said catch thread device, said horizontally extending section cooperating with said leaf spring.

6. The sewing machine in accordance with claim 4, further comprising:

a stop piece cooperating with said support, said stop piece being fastened to said catch thread device;

a torque-generating spring, said support being associated with said torque-generating spring; and a stationary stop piece is provided, which projects into a path of pivoting of said support and sets the cutting and pickup positions of said knife and of said thread clamp.

7. The sewing machine in accordance with claim 6, wherein said stop piece of said catch thread device and said stationary stop piece are adjustable.

8. The sewing machine in accordance with claim 3, wherein said thread-cutting device is used in conjunction with a camless needle plate.

9. The sewing machine in accordance with claim 4, wherein said thread-cutting device is used in conjunction with a camless needle plate.

10. The sewing machine in accordance with claim 5, wherein said thread-cutting device is used in conjunction with a camless needle plate.

11. The sewing machine in accordance with claim 5, further comprising:

a stop piece cooperating with said support, said stop piece being fastened to said catch thread device;

a torque-generating spring, said support being associated with said torque-generating spring; and a stationary stop piece is provided, which projects into a path of pivoting of said support and sets the cutting and pickup positions of said knife and of said thread clamp.

* * * * *